US011523949B2

(12) United States Patent
Anderson

(10) Patent No.: US 11,523,949 B2
(45) Date of Patent: Dec. 13, 2022

(54) INTERCHANGEABLE PUMP MOUNT FOR A WHEELCHAIR LIFT

(71) Applicant: THE BRAUN CORPORATION, Winamac, IN (US)

(72) Inventor: Nicholas Anderson, Winamac, IN (US)

(73) Assignee: The Braun Corporation, Winamac, IN (US)

( * ) Notice: Subject to any disclaimer, the term of this patent is extended or adjusted under 35 U.S.C. 154(b) by 158 days.

(21) Appl. No.: 17/151,967

(22) Filed: Jan. 19, 2021

(65) Prior Publication Data

US 2021/0220193 A1 Jul. 22, 2021

Related U.S. Application Data

(60) Provisional application No. 62/963,674, filed on Jan. 21, 2020.

(51) Int. Cl.
*A61G 3/06* (2006.01)

(52) U.S. Cl.
CPC ..... *A61G 3/062* (2013.01)

(58) Field of Classification Search
CPC ..... A61G 3/06; A61G 3/062; A61G 3/067; A61G 2220/16; B60P 1/4478; B60P 1/4442; B60P 1/4471; B60P 1/445; B66B 9/0853; B66F 7/16; F15B 2201/4056; Y10S 187/901; Y10S 414/134
USPC ..... 414/545
See application file for complete search history.

(56) References Cited

U.S. PATENT DOCUMENTS

| | | | | |
|---|---|---|---|---|
| 5,605,431 | A * | 2/1997 | Saucier | A61G 3/062 414/546 |
| 6,042,327 | A * | 3/2000 | DeLeo | A61G 3/062 414/921 |
| 9,974,702 | B2 | 5/2018 | Gallingani | |
| 2002/0136624 | A1 | 9/2002 | Ablabutyan | |
| 2002/0187032 | A1 * | 12/2002 | Richard | B60P 1/4471 414/556 |
| 2006/0104775 | A1 | 5/2006 | Kasten, Jr. et al. | |
| 2007/0183880 | A1 * | 8/2007 | Fisher | B60P 1/4442 414/546 |

(Continued)

OTHER PUBLICATIONS

International Search Report, Korean Intellectual Property Office, pp. 1-3, dated Apr. 20, 2021.

(Continued)

*Primary Examiner* — Glenn F Myers
(74) *Attorney, Agent, or Firm* — Daniel Tallitsch

(57) ABSTRACT

A lift for transferring a user to and from a vehicle, the lift including a lift platform and a pump unit to adjust the position of the lifting platform. The pump unit includes: i) a first cover having a plurality of first cover apertures to receive a plurality of connectors, ii) a pump, iii) a pump block operatively connected to the pump. The pump block includes a first side with first side block apertures and a second side with second side block apertures, wherein the first side block apertures are arranged to be collocated with the plurality of first cover apertures and the second side block apertures are arranged to be collocated with the plurality of first cover apertures. A manual pump actuator extends from one side of the pump assembly, wherein the manual pump actuator is oriented in once a first direction or a second direction with respect to the pump cover.

20 Claims, 8 Drawing Sheets

(56) References Cited

U.S. PATENT DOCUMENTS

2010/0028115 A1 2/2010 Ablabutyan et al.

OTHER PUBLICATIONS

Written Opinion, Korean Intellectual Property Office, pp. 1-5, dated Apr. 20, 2021.

* cited by examiner

INTERCHANGEABLE PUMP MOUNT FOR A WHEELCHAIR LIFT

RELATED APPLICATIONS

This application claims the benefit of U.S. Provisional Patent Application Ser. No. 62/963,674, filed Jan. 21, 2020 and entitled "FRONT/REAR INTERCHANGEABLE PUMP MOUNT FOR A WHEELCHAIR LIFT," the disclosure of which is hereby incorporated by reference in its entirety.

FIELD OF THE DISCLOSURE

The present disclosure is generally related to a wheelchair lift for use in a vehicle, and more particularly to a pump unit for a wheelchair lift to assist a mobility-challenged person, including those in wheelchairs, to enter and exit a motorized passenger vehicle.

BACKGROUND

Vehicles adapted for mobility-challenged individuals are necessary in order to provide these individuals with the ability to reach locations requiring vehicular travel. These vehicles often have electrical or hydraulic powered wheelchair lifts for assisting wheelchair occupants to both enter and exit the vehicle. Parallelogram-type wheelchair lifts are offered by a number of manufacturers, including the L900 series of lifts from The Braun Corporation of Winamac, Ind. (see, for instance, U.S. Pat. No. 5,261,779—the disclosure of which is incorporated in its entirety herein by this reference). These lifts employ various mechanisms to cause the platform to move arcuately upward from the horizontal transfer level to a vertical or over-vertical stowage position. In one or more embodiments, hydraulic cylinders are used to raise and lower the platform.

One system involves a lifting assembly including the use of an articulated lever assembly comprising a pair of arms of unequal length pivotably connected to each other at one end, and pivotably connected at their other respective ends. A vertical lift arm end link includes a bottom end pivotally secured to a platform and an inboard end of the platform. As the hydraulic cylinders of the lifting assembly are actuated by a pump/control assembly, thereby lifting the platform from the ground level toward the transfer level, a sliding block, which is pivotally secured at the common center of the two arms, comes into contact with the lower arm of the parallelogram. As the lifting continues, and the end link approaches the lower arm, the lower (longer) arm of the lever assembly is pushed downwardly. In turn, this causes the outboard end of platform to rotate upwardly to the stowed position.

The pump/control assembly is located on either side of the lifting assembly and includes a pump operatively connected to each of the hydraulic cylinders used to raise and lower the lift.

The location of the pump/control assembly can be dictated by the type of vehicle in which the lifting assembly is located. In some vehicles, the pump/control assembly is located at a rear side of the lifting assembly, toward the rear of the vehicle, and in other vehicles, the pump/control assembly is located toward a front side of the lifting assembly, toward the front of the vehicle. Because the pump/control assembly must interface with different sides of the lift assembly, there are two different types of pump/control assemblies required. Each pump/control assembly is specifically designed to be located at either the rear side or the front side. Consequently, there are two different non-interchangeable pump/control assemblies. Once a lift is in use, the front assembly is not interchangeable with the rear assembly. Additionally, the hydraulic hoses providing hydraulic pressure to hydraulic cylinders are of different lengths which can cause an unwanted tilt to the platform. What is needed, therefore, is a pump/control assembly that can be used on either side of the lift assembly.

SUMMARY

In one embodiment, there is provided a pump unit for adjusting a position of a wheelchair lift including a first hydraulic cylinder and a second hydraulic cylinder. The pump unit includes a first cover having a side wall with a plurality of first cover apertures to receive a plurality of connectors and a pump assembly. The pump assembly includes a pump block, wherein the pump block having a first side with first side block apertures and a second side with second side block apertures. The first side block apertures are arranged to be collocated with the plurality of first cover apertures and the second side block apertures are arranged to be collocated with the plurality of first cover apertures. A manual pump actuator extends from one side of the pump assembly, wherein connection of the first side block apertures to the first cover apertures orients the manual pump actuator in a first direction with respect to the pump cover and connection of the second side block apertures to the first cover apertures orients the manual pump actuator in a second direction with respect to the pump cover.

In another embodiment, there is provided a lift for transferring a user to and from a vehicle. The lift includes a lift platform for receiving the user, the lift platform being movable between a first position and a second position. A lifting assembly is coupled to the lift platform, the lifting assembly includes a first hydraulic cylinder and second hydraulic cylinder. A pump unit adjusts the position of a lifting assembly and includes: i) a first cover having a plurality of first cover apertures to receive a plurality of connectors, ii) a pump, iii) a pump block operatively connected to the pump. The pump block includes a first side with first side block apertures and a second side with second side block apertures, wherein the first side block apertures are arranged to be collocated with the plurality of first cover apertures and the second side block apertures are arranged to be collocated with the plurality of first cover apertures. A manual pump actuator extends from one side of the pump assembly, wherein connection of the first side block apertures to the first cover apertures orients the manual pump actuator in a first direction with respect to the pump cover and connection of the second side block apertures to the first cover apertures orients the manual pump actuator in a second direction with respect to the pump cover.

In a further embodiment, there is provided a method of configuring a pump unit to be located at one of a rear side or a front side of a lift for transferring a user to and from a vehicle. The pump unit includes a first cover having first cover features, a second cover having second cover features, and a pump assembly. The method includes: disengaging the first cover features from the second cover features to disengage the first cover from the second cover; determining a first orientation of the pump assembly with respect to one of the first cover and the second cover; removing the pump assembly from one of the first cover and the second cover; determining a second orientation of the pump assembly with respect to the one of the first cover and the second cover from which the pump assembly was removed, wherein the second orientation is about one-hundred eighty degrees different than the first orientation; connecting the pump assembly in the second orientation to the one of the first cover and the second cover from which the pump assembly was removed; engaging the first cover features to the second cover features to engage the first cover to the second cover.

BRIEF DESCRIPTION OF THE DRAWINGS

The above-mentioned aspects of the present invention and the manner of obtaining them will become more apparent and the invention itself will be better understood by reference to the following description of the embodiments of the invention, taken in conjunction with the accompanying drawings, wherein.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Unless defined otherwise, all technical and scientific terms used herein have the same meaning as commonly understood by one of ordinary skill in the art to which this invention belongs. Although any method and materials similar or equivalent to those described herein can be used in the practice or testing of the present invention, the specific methods and materials are now described. Moreover, the techniques employed or contemplated herein are standard methodologies well known to one of ordinary skill in the art and the materials, methods and examples are illustrative only and not intended to be limiting.

Figure 1:
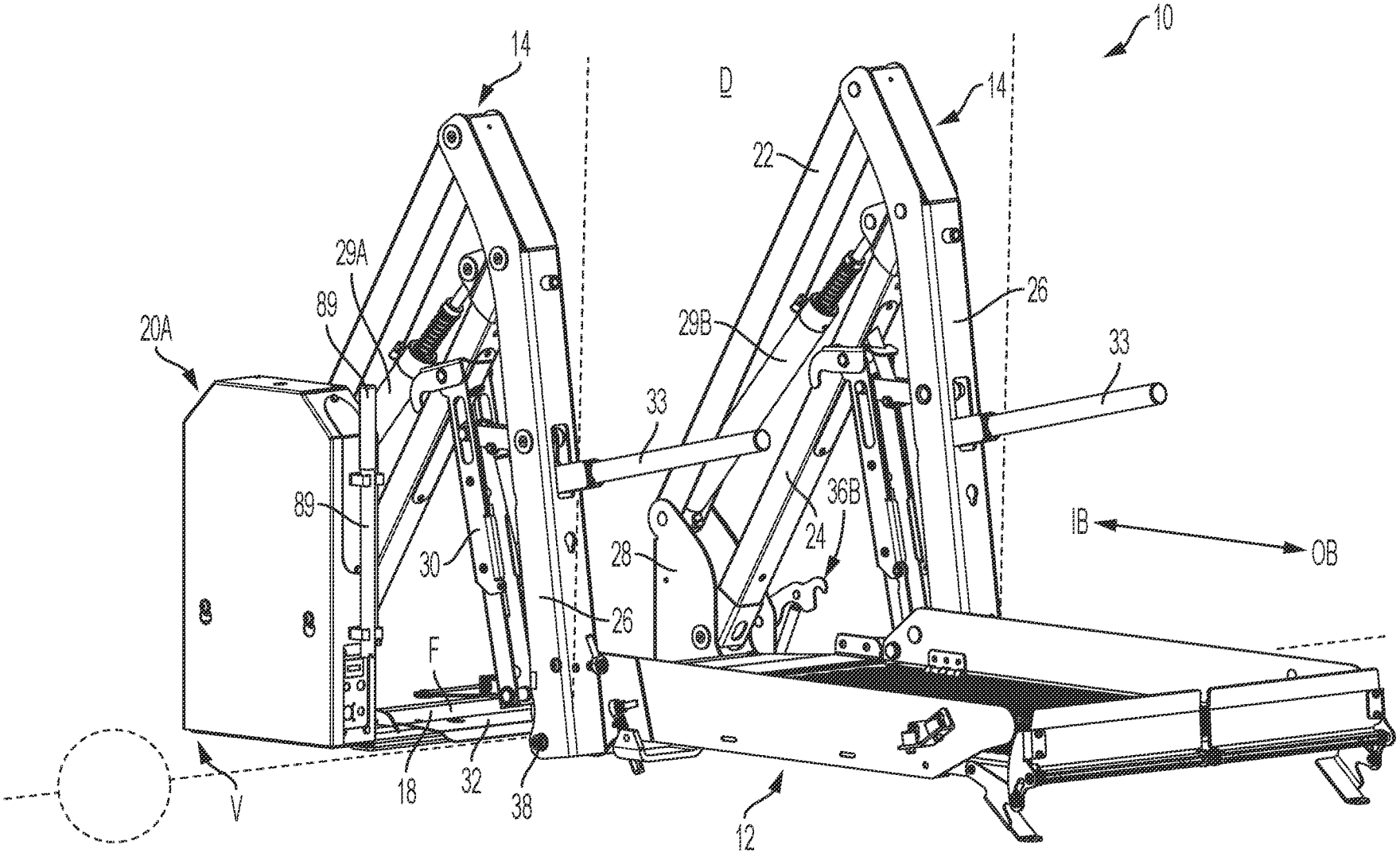
FIG. 1 illustrates a front left side perspective view of a wheelchair lift.

FIG. 1 shows the general arrangement of an illustrative vehicle-mounted parallelogram-type wheelchair lift 10 with a platform assembly 12 located at a position between a stowed position and a deployed position. The lift 10 is shown mounted to a vehicle (V) at its floor (F). It should also be noted that the inboard (IB) and outboard (OB) loading and unloading orientations are indicated by arrows IB/OB. The parallelogram lift 10 includes the platform assembly 12 (also referred to herein as the "lift platform"), having paired parallelogram arm lifting assemblies or linkages 14, vehicle mounting base assembly 16 including mounting plate or baseplatel8, and hydraulic pump/control unit 20 mounted to the vehicle V at a side door (D) opening. As used herein the hydraulic pump/control unit 20 is a control assembly 20 that includes both a hydraulic pump and control features.

Each parallelogram arm lifting assembly 14 comprises an upper arm 22 and a lower arm 24, a vertical channel end link 26 and a base-mounted bracket member or side support assembly tower/frame 28, including a baseplate weldment, which serves as a base link for arms. A hydraulic cylinder 29 is coupled to the side support assembly tower/frame 28 which when actuated moves the platform assembly from the stowed position to the deployed position and from the deployed position to the stowed position. The platform assembly 12 is pivotally connected to the end links 26 at pivot point 28, while the lower portion of each vertical channel end link 26 is provided with a linkage mechanism 30 that causes an inboard barrier 32 to move in an automatic or otherwise coordinated manner relative or in response to the platform state (e.g., raising, lowering, etc.). An arm 33 extend from each of the vertical end links 26.

In accordance with certain aspects herein, the vehicle lift 10 can employ a system or assembly of linkage members, such as arms, to move and synchronize the inboard barrier 32 relative to the elevation of the lift platform 12 (see, for example, U.S. Pat. No. 6,238,169, the disclosure of which is incorporated by reference herein in its entirety). In accordance with one illustrative embodiment, the vehicle lift 10 has the stowable lift platform 12 and the inboard barrier 32 is pivotably coupled thereto to be actuated by an inboard barrier linkage mechanism 30 for movement between a raised safety position and a lowered bridging position in synchronism with the elevation of the lift platform 12. The linkage mechanism has a pivoting elbow member for pivoting the lift platform 12 from the horizontal transfer position to a generally vertical stowed position. A chain/spring link which couples the fold arm to the inboard barrier, causes the barrier to rotate from a raised position to a substantially horizontal position to act as a bridgeplate at the transfer level.

It should be understood and appreciated herein that the various arms/linkages of the arm lifting assemblies 14 disclosed herein may have pivot points or connections that are in the form of plug-in pin connections. In addition, these pivot points may include bushings (not shown) within their respective bores to reduce wear on their associated parts.

As seen in FIG. 1, a lift latch assembly 36B is located adjacent to the vehicle mounting base assembly 16. When the platform assembly 12 is in the folded position (platform vertical), the platform can begin to drift outwards. The latch assembly 36B catches the platform assembly 12 should the lift begin to drift and prevents the platform from contacting a vehicle door while installed in a van. The latch assembly includes a slow moving gas strut, so that when the platform deploys under normal conditions, the latch does not catch the platform, Under the slow moving drift condition, however; the latch holds the platform near the vertical position.

These latches exist on both the front and rear side of the wheelchair lift, and the latch arms extend in the same direction (outboard). See FIG. 2 for the latch assembly 36A. (For further details of a latch assembly, see for example, U.S. Pat. No. 6,599,079, the disclosure of which is incorporated by reference herein in its entirety.) In FIG. 1, the lift latch assembly 36A is hidden by the control assembly 20.

Figure 2:
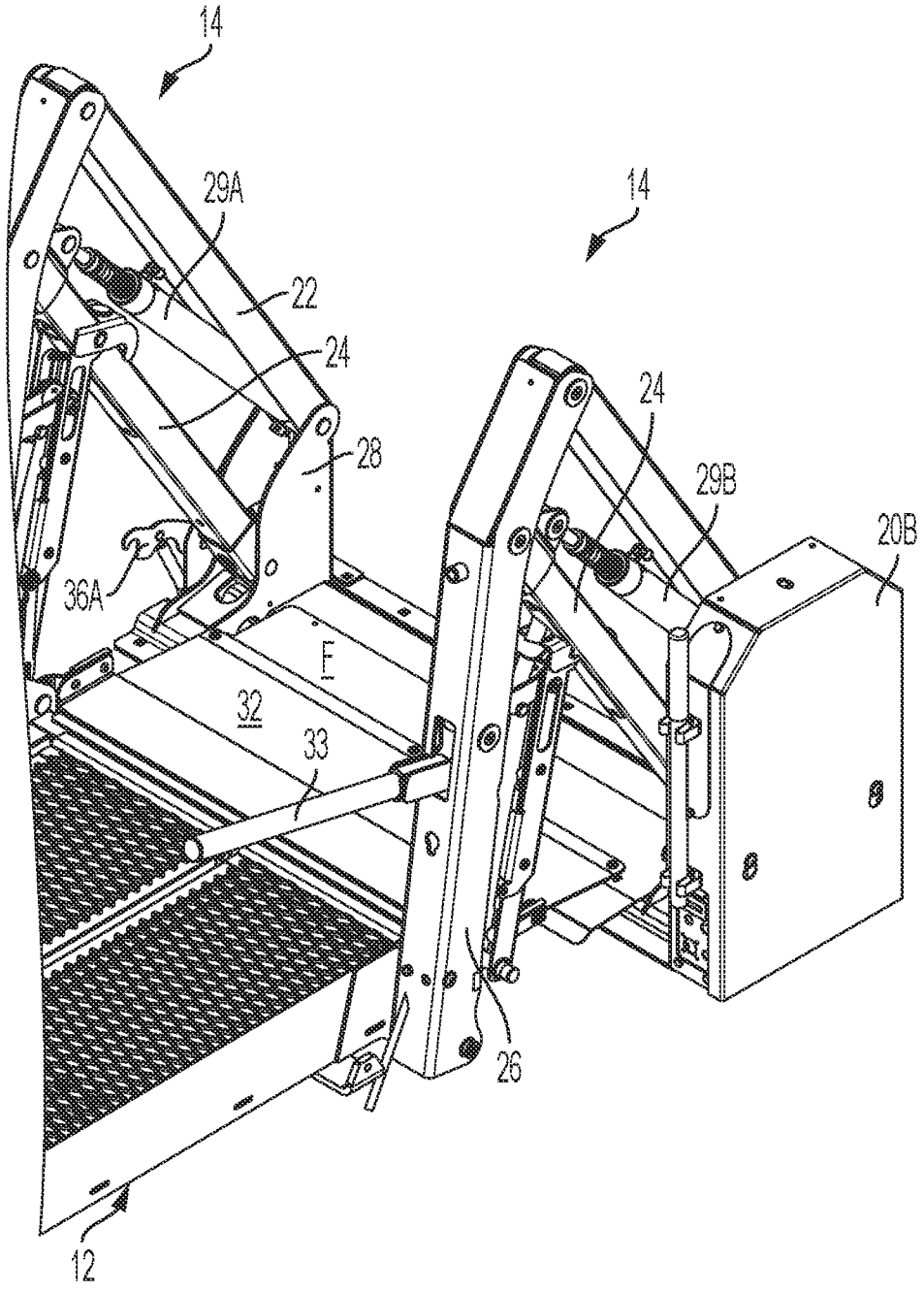
FIG. 2 illustrates a front right side perspective view of a wheelchair lift.

The control assembly 20 is interchangeably located on either a rear side of the lift assembly 10 as illustrated on a rear side in FIG. 1 as control assembly 20A, or on a front side as illustrated in FIG. 2 as control assembly 20B. As seen in FIGS. 1 and 2, the wheel chair lift 10 is mounted to a vehicle having a left side driver's position for countries in which the vehicle drives in the right lane of traffic. Consequently, the lift 10 is illustrated as being mounted on a right side of the vehicle such that the location of the control assembly 20A is located toward the rear of the vehicle, which is considered a rear mount position, in FIG. 1. In FIG. 2, the control assembly 20B is located toward the front of the vehicle which is considered a front mount position.

As seen in FIG. 2, the structure of the wheelchair lift 10 is substantially the same as the wheelchair lift 10 of FIG. 1, except for the location of the control assembly 20B. Only one control assembly 20 is required for mounting at either the rear side or the front side of the lift. The location of the control assembly 20 is dictated by the configuration of the vehicle in which the wheelchair lift 10 is mounted or is determined by a preferred location selected by the installer of the wheelchair lift 10.

Figure 3:
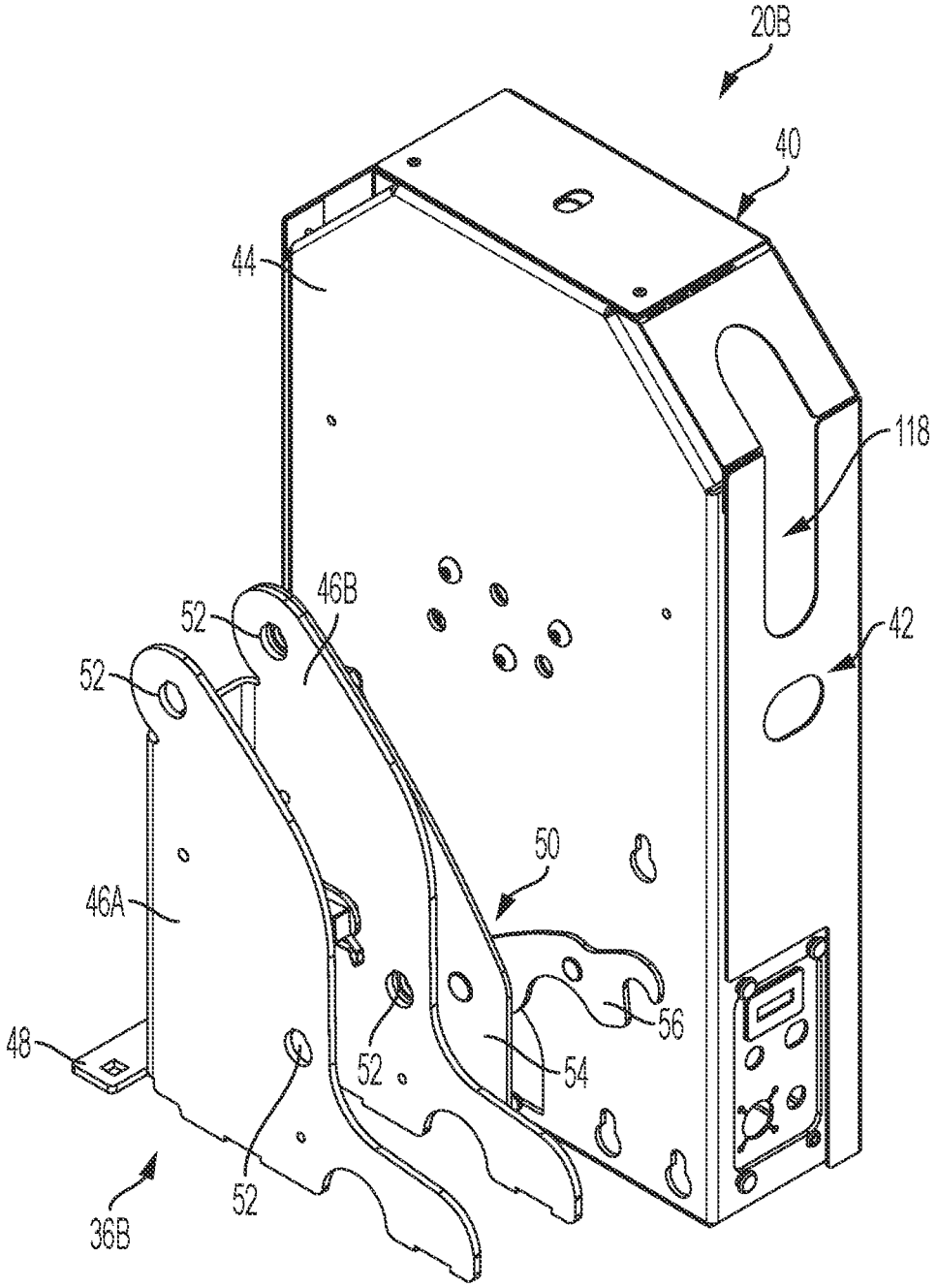
FIG. 3 illustrates one embodiment of a control assembly configured to move the wheelchair lift.

The control assembly 20B is further illustrated in FIG. 3 and includes a housing 40 having a slot cover 42 operatively connected to a pump cover 44. Disposed adjacently to the housing 40 is the latch assembly 36B that includes first and second side plates 46A and 46B which are fixedly connected to a base plate 48. A latch arm assembly 50 is supported by the side plate 46B and located adjacently to the pump cover 44. In the one embodiment, as illustrated in FIG. 3, each of the first and second side plates 46A and 46B includes similarly configured apertures 52 which are adapted to connect one of the side plates 46 to a mounting plate 54. The first and second side plates 46A and 46B are configured to rotatably support an arm 56 which moves to catch the platform assembly 12 should the lift drift to prevent the platform from contacting a vehicle door while installed in a van. When the latch assembly is moved to the location of FIG. 1, the mounting plate 54 is moved, and connected to the side plate 46A to be configured as the latch assembly 36A of FIG. 1 and further illustrated in FIG. 4. In one or more embodiments, the term "slot cover" defines the location of the slots. In other embodiments, the slots are located at the pump cover 44, and consequently, the slot cover 42 is no longer considered to be a slot cover due to the lack of slots on the cover 42.

Figure 4:
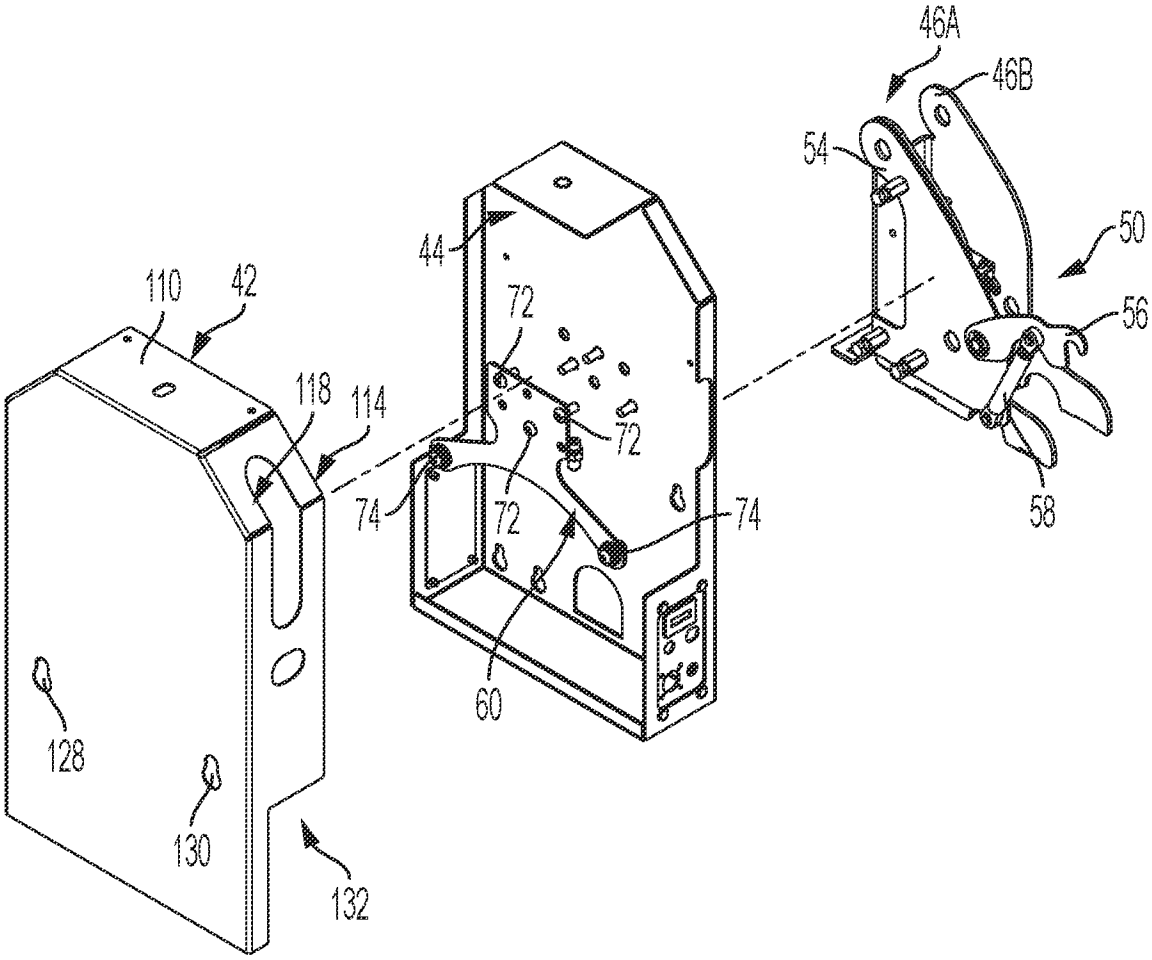
FIG. 4 illustrates an exploded view of another embodiment of a control assembly configured to move the wheelchair lift.

As seen in FIG. 4, the control assembly 20 is reconfigured to be located in the position of control assembly 20A of FIG. 1. In this configuration the first and second sides 46A and 46B remain in the same orientation as illustrated in FIG. 3. In this embodiment, however, the mounting plate is moved from side 46B to side 46A such that the latch arm 56 of the latch arm assembly 50 is moved to the side plate 46A. As can be seen in FIG. 4, the latch arm assembly 50 includes a hydraulic actuator 58 operatively connected to the latch arm 56 and to the mounting plate 54.

Figure 5:
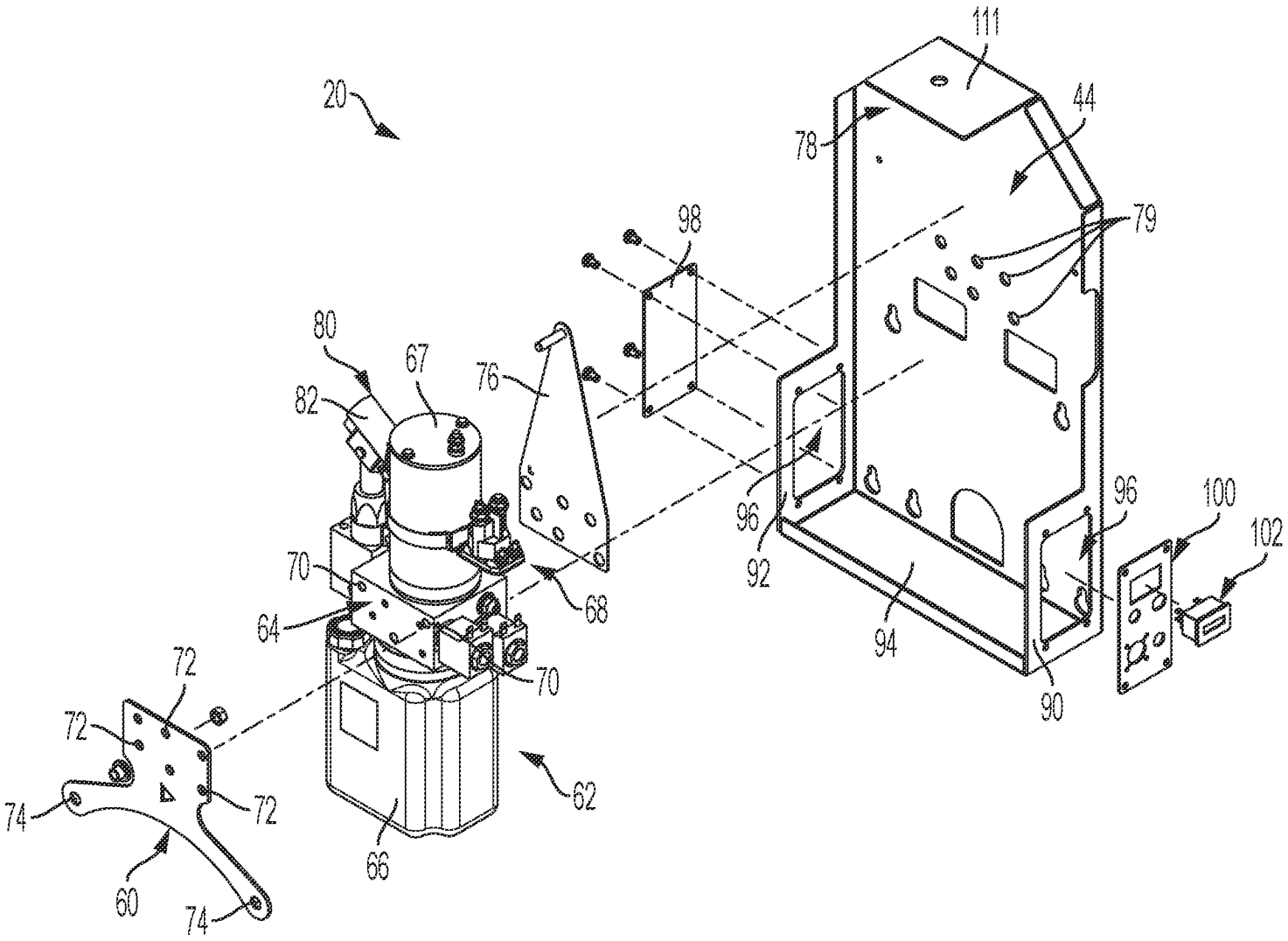
FIG. 5 illustrates an exploded view of the embodiment of FIG. 4 including additional components.
Figure 6:
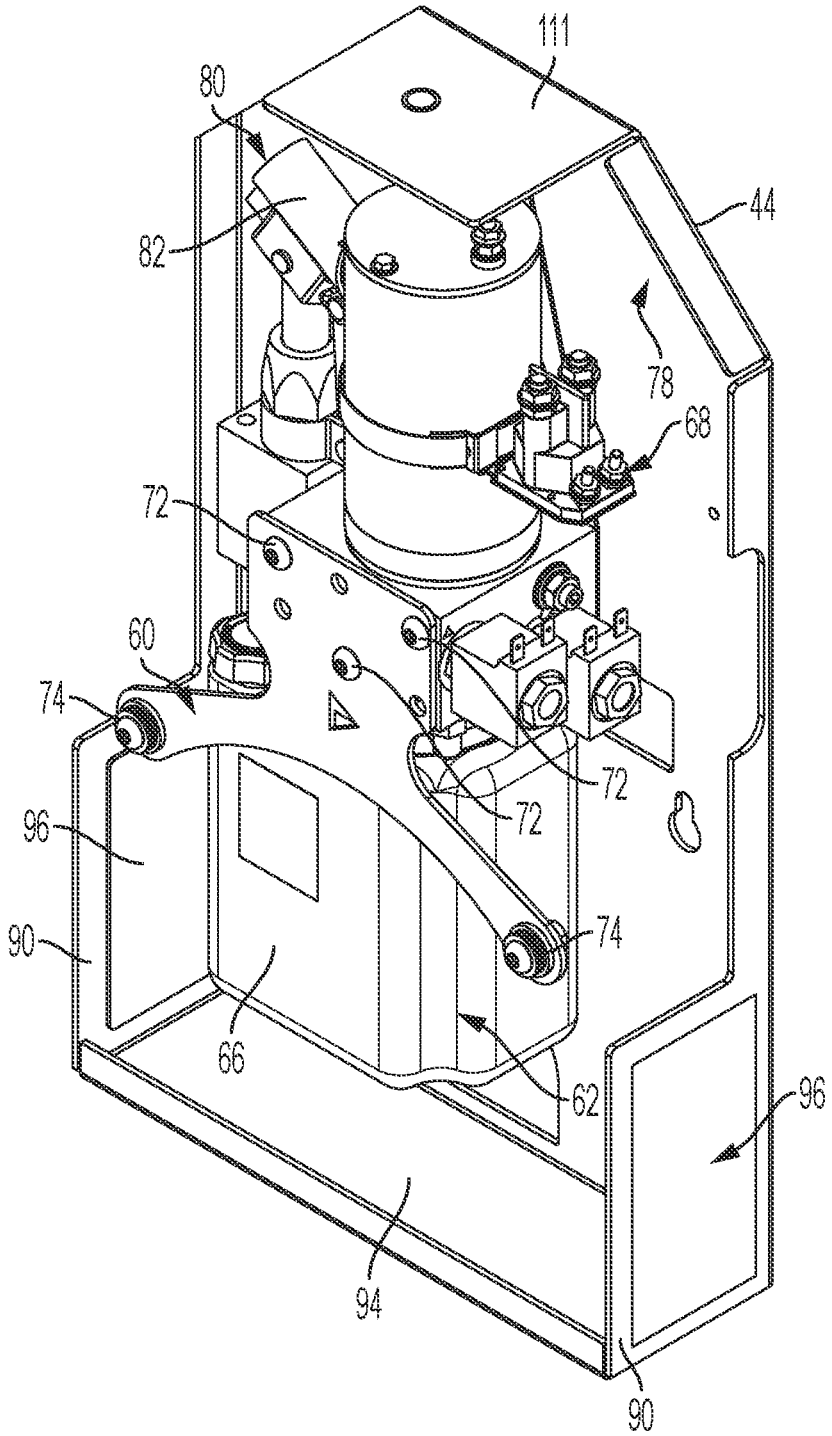
FIG. 6 illustrates a non-exploded view of the embodiment of FIG. 5.

When the control assembly 20 is moved toward the rear side of the vehicle, the slot cover 42 and the pump cover 44 change orientations with respect to the platform 12 when compared to the orientations of FIG. 4. A mounting bracket 60 is located within the housing 20 and is fixedly connected to the pump cover 44 to locate a pump assembly 62 as illustrated in FIG. 5. The pump assembly 62 includes a pump block 64 coupled to a pump 66 and a capacitor 67 which supports a controller 68. The pump block 64 includes a plurality of apertures 70 arranged to receive pump block connectors (not shown) inserted through apertures 72 of the mounting bracket 60. See also FIG. 4 showing the apertures 72 configured to receive pump block connectors. The mounting bracket also includes apertures 74 that receive cover connectors inserted through the slot cover 42 to complete assembly of the housing 40. In FIGS. 4 and 6, the apertures 74 are illustrated as including connectors configured to engage the slot cover 42 as described later herein.

The pump block connectors extend through the apertures 72 and 70. The apertures 72 and 70 are arranged to be collocated. The pump block 64 further includes apertures (not shown) on an opposite side aligned with apertures of a ground plate 76 disposed between the pump block 64 and an interior surface of a sidewall 78 of the pump cover 44. The ground plate 76 provides an electrical ground for the controller 68 and other associated electronic components to provide a grounding path as would be understood by one skilled in the art. The sidewall 78 includes apertures 79 to receive the pump block connectors to fix the pump assembly 62 to the pump cover 44. A manual pump actuator 80 is located adjacent to and operatively connected to the pump 66 in the event that power for adjusting the pump is insufficient or lost altogether. The manual pump actuator 80 includes a receiver 82 configured to receive a handle 89 (see FIG. 1) for manual actuation of the pump 66 to adjust the position of the platform assembly 12. As described herein the described apertures are connecting features that provide for coupling one part to another part.

The pump cover 44 includes a first side support section 90 and a second side support section 92 each of which extends generally perpendicular to the sidewall 78 of the pump cover 44. A bottom portion 94 of the pump cover 44 extends between the two side support sections 90 and 92. Each of the side support sections include an opening 96 configured to receive either a cover plate 98 or a display plate 100. The cover plate 98 and the display plate 100 are interchangeable and the location of each is dependent on the location of the control assembly 20. The display plate 100 includes one or more apertures configured to receive a display 102 and related control features such as an on/off switch, one or more knobs or buttons (not shown) each of which includes wiring inserted through apertures of the display plate 100 to connect to the controller 68. In one embodiment, the display 102 is an LCD display configured to display a visual indication of the number of times or cycles (a count) which the platform assembly 12 has been moved. In one embodiment, the counter is not resettable and in another embodiment, the counter is resettable. When the control assembly 20 is moved to the forward side as assembly 20B, the locations of the display plate 100 and the cover plate 98 are switched so that the display 102 faces toward the outbound side of the vehicle. FIG. 6 illustrates the pump assembly 62 mounted to the pump cover 44.

Figure 7:
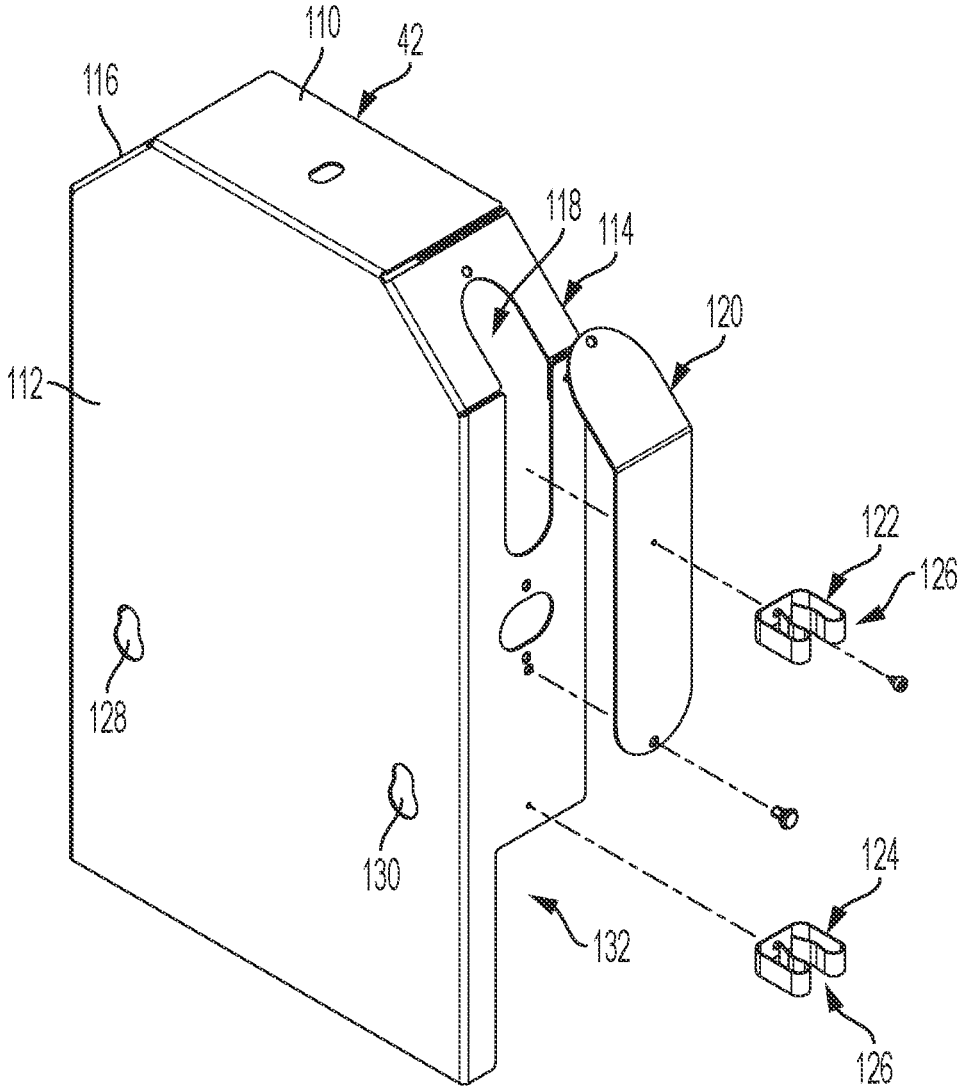
FIG. 7 illustrates a slot cover of the control assembly of FIG. 4.

As seen in FIG. 5, the control assembly 20 is configured to be located on the rear side of the platform assembly 12 and includes the slot cover 42 oriented in the direction shown in FIGS. 4 and 7. The slot cover 42 includes a top wall 110 extending generally perpendicular from a back wall 112. The top wall 110 engages a top wall 111 of the pump cover 44. A first sidewall 114 and a second sidewall 116 extend generally perpendicular from the back wall 112. Each of the sidewalls 114 and 116 includes an aperture 118 generally configured as a slot to receive the handle 89 that is inserted into the receiver 82. When the handle 89 is in use, the handle 89 moves up and down along the slotted aperture 118. In FIG. 5, it can be seen that the handle 89 would extend through the slot of the sidewall 116 of FIG. 7. In another embodiment, the pump actuator 80 is located toward the outbound side of the vehicle such that handle 89 would extend through the slotted aperture 118 of the sidewall 114.

A slot cover 120 includes a length sufficient to cover the slotted aperture 118 of the sidewall 114 or the slotted aperture of the sidewall 116. A first clamp 122 and a second clamp 124 each define a receiving portion 126 adapted to receive the handle 89 such as is illustrated in FIG. 1. One or more apertures located on the sidewall and one or more apertures located on the cover 120 are configured to receive connectors to connect the clamps to the slot cover 42. The clamps are oriented with respect to the cover 42 to support the handle 89 in a generally vertical position. Since either one of the slots in one of the sidewalls 114 or 116 can be covered and since the slot cover can positioned in two different locations of the control assembly 20 with respect to the platform assembly 12, the slot cover 42 accommodates both outbound and inbound orientations of the handle 89 when the control assembly 20 is located at either the forward or rearward position with respect to the platform assembly 12. The slot cover 42 includes a first aperture 128 and a second aperture 130 configured to engage connectors located at the apertures 74 of the mounting bracket 60.

The slot cover 42 further includes a first cutout 132 adjacent to the sidewall 114 and a second similar cutout (not shown) adjacent to the sidewall 116. Each of the cutouts are configured to expose the first side support section 90 and a second side support section 92 of pump cover 44 such that the display 102 is locatable on either support section of the pump cover 44 depending on whether the control assembly 20 is in located in the forward or the rearward position.

Figure 8:
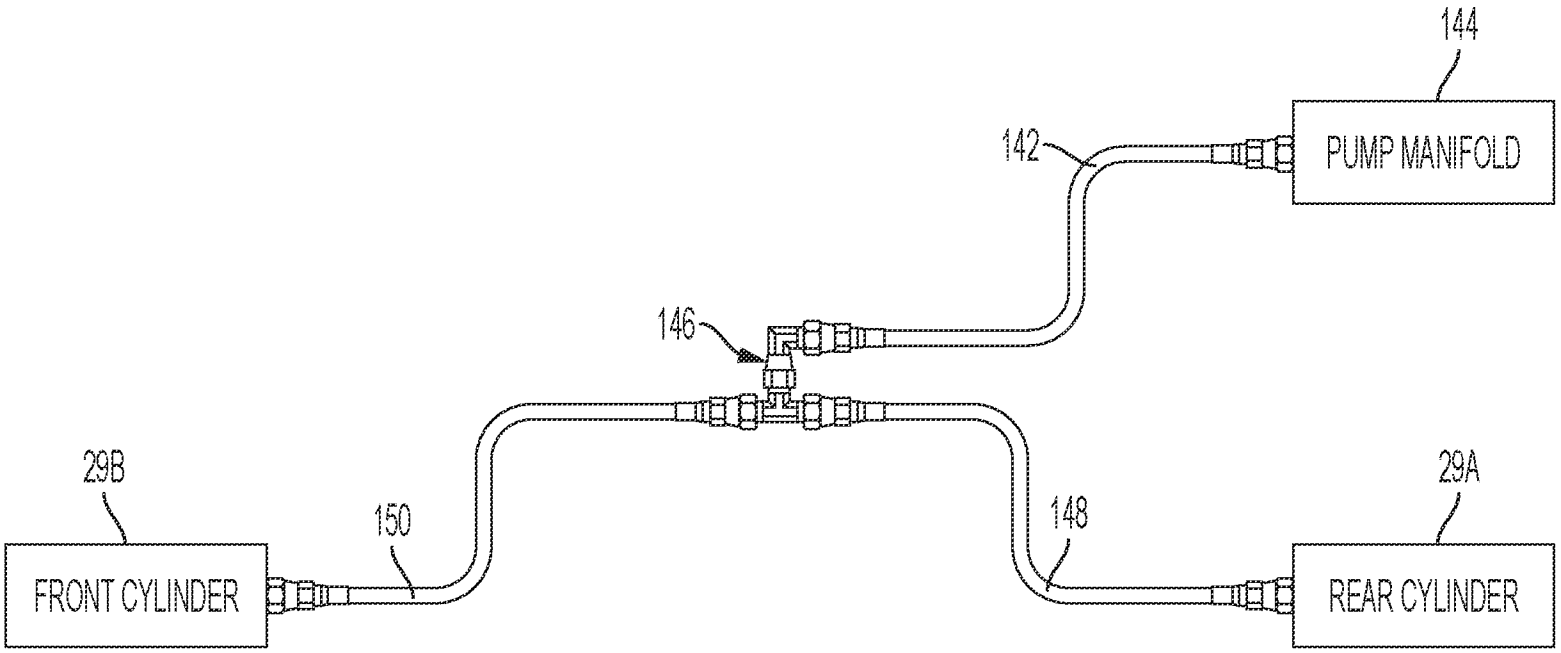
FIG. 8 illustrates a conformable hose assembly to provide fluid to the control assembly of FIGS. 1 and 2.

As seen in FIG. 4, the slot cover 42 includes the slots 118 and the cutouts 132. The pump cover 44 includes the support sections 90 that are configured to align with the cutouts 132 when the slot cover 42 is connected to the pump cover 44. Other embodiments are contemplated, however, in which the slots, the cutouts, and the support sections are located on different covers. For instance, in one embodiment, the slots 118 are part of the pump cover 44 and the support sections 90 are part of the slot cover 42. In this embodiment, the cutouts 132 would be located at the slot cover 44. In other embodiments, one of the support sections 90 is located on the pump cover 44 and the other of the support sections 90 is located on the slot cover. Likewise, in one or more embodiments, one of the slots 118 is part of the pump cover 44 and the other of the slots 118 is part of the slot cover. Consequently, As described with respect to FIGS. 1 and 2, the location of the control assembly 20 is determined by the configuration of the vehicle in which the wheelchair lift 10 is located or by the preference of an installer or a user of the vehicle. Because the control assembly 20 is locatable at either a forward location or a rearward location, a conformable hose assembly 140 of FIG. 8 connects the pump 66 to both the front hydraulic cylinder 29B and the rear hydraulic cylinder 29A of FIGS. 1 and 2. A first hose 142 is operatively connected to a pump manifold 144 of the pump 66. The first hose 142 is coupled to a fluid swivel connector 146 which operatively connects both the rear cylinder 29A and the front cylinder 29B to the pump manifold. A second hose 148 connects the rear cylinder to 29A to the pump manifold 144 through the fluid swivel connector 146 and a third hose 150 connects the front cylinder 29B to the pump manifold 144 through the fluid swivel connector 144.

Each of the second hose 148 and the third hose 150 include substantially a same length such that the swivel connector 146 is centrally located between the rear cylinder 29A and the front cylinder 29B. Depending on the location of the control assembly 20, the swivel connector 146 enables the first hose 142 to extend toward either the front or the rear of the vehicle where the control assembly 20 is located. In one embodiment, the vehicle mounting base 16 includes a raised area spaced from the vehicle floor to conceal the fluid swivel connector 146 and the first, second, and third hoses 142, 148, and 150. Because at least the second hose 148 and the third hose 150 are substantially the same length, the fluid pressure within each of these hoses is also substantially similar. The fluid pressure delivered to each of the cylinders 29A and 29B is therefore also substantially similar. By providing substantially similar fluid pressures to each of the hydraulic cylinders 29A and 29B, each of the arm lift assemblies 14 move in substantially in unison to maintain the platform assembly 12 in a substantially level plane when moving from the stowed position and the deployed position and from the deployed position to the stowed position.

The control assembly in FIG. 4 is configured as control assembly 20A of FIG. 1 to be used on the rearward side of the wheelchair lift 10. The same components of the control assembly of FIG. 4 are reconfigurable to provide the control assembly 20B of FIG. 3 as located on the forward side of the wheelchair lift 10 of FIG. 2. To modify the control assembly 20 between the configurations of control assembly 20A and 20B, pump assembly is removed from the pump cover 44. Once removed, the mounting bracket 60 is removed from the side of the pump block 64 where currently attached, and attached to the other side of pump block 64. Once attached, the pump assembly 62 is reoriented and rotated one-hundred and eighty (180) degrees. Once reoriented, the pump assembly 62 and mounting bracket 60 are reattached to the pump cover 44. The cover plate 98 and the display plate 100 are interchanged so that the display 102 is directed to the outbound side of the vehicle. In addition, the various cables connected to the display 102 and other parts and components supported by the display plate 100 must be removed from those components and reconnected ones the display plate 100 and display 102 are appropriately located. The cover 120 is also moved from one of the sidewalls 114 or 116 to the other of the sidewalls 114 or 116 to enable the handle 89 to be directed to the OB side.

While exemplary embodiments incorporating the principles of the present invention have been disclosed herein, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A pump unit for adjusting a position of a wheelchair lift including a first hydraulic cylinder and a second hydraulic cylinder, the pump unit comprising:

a first cover including a side wall having a plurality of first cover apertures to receive a plurality of connectors;

a pump assembly including a pump block, wherein the pump block includes a first side having first side block apertures and a second side having second side block apertures, wherein the first side block apertures are arranged to be collocated with the plurality of first cover apertures and the second side block apertures are arranged to be collocated with the plurality of first cover apertures, and a manual pump actuator extending from one side of the pump assembly, wherein connection of the first side block apertures to the first cover apertures orients the manual pump actuator in a first direction with respect to the pump cover and connection of the second side block apertures to the first cover apertures orients the manual pump actuator in a second direction with respect to the pump cover.

2. The pump unit of claim 1 further comprising a mounting bracket, the mounting bracket includes mounting bracket apertures arranged to be collocated with the first side block apertures and to be collocated with the second side block apertures.

3. The pump unit of claim 2 further comprising a second cover connected to the first cover, wherein one of the first cover and the second cover includes two slots to provide access to the manual pump actuator in either the first direction of the second direction.

4. The pump unit of claim 3 wherein the second cover includes second cover apertures and a portion of the mounting bracket apertures are arranged to align with the second cover apertures to connect the first cover to the second cover with one or more connectors.

5. The pump unit of claim 4 further comprising a display plate, wherein one of the first cover and the second cover includes a first opening and a second opening and the display plate is located at one of the first opening and the second opening to cover at least a part of the first opening and the second opening.

6. The pump unit of claim 5 further comprising a cover plate, wherein the cover plate is located at the other of the first opening and the second opening to cover the first opening or the second opening.

7. The pump unit of claim 6 further comprising a slot cover, wherein the slot cover covers one of the two slots of the first cover or the second cover.

8. The pump unit of claim 7 wherein one of the first cover and the second cover includes a cutout, wherein the cutout uncovers the display plate when the first cover and the second cover are connected.

9. The pump unit of claim 8 further comprising a display located at the display plate, wherein the display displays alphanumeric characters.

10. The pump unit of claim 9 further comprising a hose assembly operatively connected to the pump assembly, wherein the pump assembly includes a first hose and a second hose having a substantially similar length to the first hose, wherein the hose assembly develops a substantially similar fluid pressure in each of the first hose and the second hose to position the wheelchair lift in a relatively level position.

11. A lift for transferring a user to and from a vehicle, comprising:

a lift platform for receiving the user, the lift platform being movable between a first position and a second position;

a lifting assembly coupled to the lift platform, the lifting assembly including a first hydraulic cylinder and second hydraulic cylinder; and a pump unit to adjust the position of a lifting assembly, the pump unit including: i) a first cover having a plurality of first cover apertures to receive a plurality of connectors, ii) a pump, iii) a pump block operatively connected to the pump, the pump block having a first side with first side block apertures and a second side with second side block apertures, wherein the first side block apertures are arranged to be collocated with the plurality of first cover apertures and the second side block apertures are arranged to be collocated with the plurality of first cover apertures, and iii) a manual pump actuator extending from one side of the pump assembly, wherein connection of the first side block apertures to the first cover apertures orients the manual pump actuator in a first direction with respect to the pump cover and connection of the second side block apertures to the first cover apertures orients the manual pump actuator in a second direction with respect to the pump cover.

12. The lift of claim 11 wherein the pump unit includes a second cover connected to the first cover, wherein one of the first cover and the second cover includes two slots to provide access to the manual pump actuator in either the first direction of the second direction.

13. The lift of claim 12 wherein the second cover includes second cover apertures and a mounting bracket, coupled to the one of the first side block apertures or second side block apertures, is aligned with the second cover apertures to connect the first cover to the second cover with one or more connectors.

14. The lift of claim 13 wherein the pump unit includes a display plate, wherein one of the first cover and the second cover includes a first opening and a second opening and the display plate is located at one of the first opening and the second opening to cover at least a part of the first opening and the second opening.

15. The lift of claim 14 wherein the pump unit includes a cover plate, wherein the cover plate is located at the other of the first opening and the second opening to cover the first opening or the second opening.

16. The lift of claim 15 wherein the pump unit includes a slot cover, wherein the slot cover covers one of the two slots of the first cover and the second cover.

17. The lift of claim 7 wherein one of the first cover and the second cover includes a cutout, wherein the cutout uncovers the display plate when the first cover and the second cover are connected.

18. The lift of claim 17 wherein the pump unit includes a display located at the display plate, wherein the display displays alphanumeric characters.

19. The lift of claim 18 further comprising a hose assembly operatively connected to the pump assembly, wherein the pump assembly includes a first hose and a second hose having a substantially similar length to the first hose, wherein the hose assembly develops a substantially similar fluid pressure in each of the first hose and the second hose to position the wheelchair lift in a relatively level position.

20. A method of configuring a pump unit to be located at one of a rear side or a front side of a lift for transferring a user to and from a vehicle, the pump unit including a first cover having first cover features, a second cover having second cover features, and a pump assembly, the method comprising:

disengaging the first cover features from the second cover features to disengage the first cover from the second cover;

determining a first orientation of the pump assembly with respect to one of the first cover and the second cover;

removing the pump assembly from one of the first cover and the second cover;

determining a second orientation of the pump assembly with respect to the one of the first cover and the second cover from which the pump assembly was removed, wherein the second orientation is about one-hundred eighty degrees different than the first orientation;

connecting the pump assembly in the second orientation to the one of the first cover and the second cover from which the pump assembly was removed;

engaging the first cover features to the second cover features to engage the first cover to the second cover.

* * * * *